US009194391B2

(12) United States Patent
Aso

(10) Patent No.: US 9,194,391 B2
(45) Date of Patent: Nov. 24, 2015

(54) SOLVENT DELIVERY PUMP PLUNGER BACKUP SEAL

(75) Inventor: Yoshiaki Aso, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 785 days.

(21) Appl. No.: 13/189,934

(22) Filed: Jul. 25, 2011

(65) Prior Publication Data

US 2012/0031264 A1 Feb. 9, 2012

(30) Foreign Application Priority Data

Aug. 3, 2010 (JP) ..... 2010-174112

(51) Int. Cl.
*F01B 29/00* (2006.01)
*F04B 53/16* (2006.01)

(52) U.S. Cl.
CPC ..... *F04B 53/164* (2013.01); *F04B 53/162* (2013.01); *F05C 2225/12* (2013.01)

(58) Field of Classification Search
CPC ..... F04B 53/164; F04B 7/00; F04B 53/162; F16J 15/166; F16J 15/168; F16J 15/18; F16J 15/181; F16J 15/182; F16J 15/188; F16J 15/20; F16J 15/32; F16J 15/3204; F16J 15/322; F16J 15/3268; F16J 15/56
USPC ..... 92/168
See application file for complete search history.

(56) References Cited

U.S. PATENT DOCUMENTS

| | | | | |
|---|---|---|---|---|
| 4,576,386 | A * | 3/1986 | Benson et al. | 277/584 |
| 5,890,415 | A * | 4/1999 | Asou | 92/128 |
| 2006/0066058 | A1* | 3/2006 | Holt et al. | 277/584 |
| 2006/0140778 | A1* | 6/2006 | Warren | 417/53 |
| 2008/0136118 | A1* | 6/2008 | Ando et al. | 277/530 |
| 2010/0237566 | A1* | 9/2010 | Balsells et al. | 277/550 |
| 2011/0227291 | A1* | 9/2011 | Toynbee | 277/500 |

FOREIGN PATENT DOCUMENTS

JP 2001-254686 A 9/2001

* cited by examiner

*Primary Examiner* — Dwayne J White
*Assistant Examiner* — Matthew Wiblin
(74) *Attorney, Agent, or Firm* — Westerman, Hattori, Daniels & Adrian, LLP

(57) ABSTRACT

A plunger seal and a backup ring are provided at a portion of a pump chamber through which a plunger is inserted. A back face of the backup ring is supported on a wall face of a cleaning chamber. The backup ring is a combined backup ring including two resin layers, i.e., a deformable resin layer and a non-deformable resin layer. A face of the backup ring in contact with the plunger seal is made up of a face of the deformable resin layer and an inner peripheral face is made up of a face of the non-deformable resin layer. The deformable resin layer has a higher elastic modulus than the plunger seal and having such an elastic modulus as to be able to absorb deformation of the plunger seal. The non-deformable resin layer has a higher elastic modulus than resin of the deformable resin layer.

8 Claims, 4 Drawing Sheets

SOLVENT DELIVERY PUMP PLUNGER BACKUP SEAL

BACKGROUND OF THE INVENTION

1. Field of the Invention

The present invention relates to a solvent delivery pump for sending a solution by sliding a plunger in a pump head to repeatedly suck the solution from a sucking port and discharge the solution from a discharge port.

2. Description of the Related Art

A schematic sectional view of a vicinity of a pump chamber of an ordinary plunger-type solvent delivery pump is shown in FIG. 3A.

The solvent delivery pump sends a solution with the tip end portion of a plunger 3 sliding in a pump chamber 8*a* in a pump head 8 to repeatedly suck the solution from a sucking port 8*b* and to discharge the solution from a discharge port 8*c*. At a portion of the pump chamber 8*a* through which a plunger 3 is inserted, a resin plunger seal 13 in close contact with an outer periphery of the plunger 3 for preventing leakage of the solution from a clearance between an inner wall of the pump chamber 8*a* and the outer periphery of the plunger 3 is provided. The pump head 8 is retained on a pump body 18. The plunger seal 13 is sandwiched between the pump head 8 and the pump body 18.

The pump body 18 supports a back face of the plunger seal 13 on its wall face on a side of the pump head 8. This wall face is provided with a hole 20 through which the plunger 3 is to be passed. If a clearance between the hole 20 and the plunger 3 is large, cold flow occurs and an inner peripheral portion of the plunger seal 13 may enter the clearance between the hole 20 and the plunger 3 in some cases as shown in FIG. 3B when solution sending pressure becomes high (e.g., about 40 MPa). In this state, friction between the plunger 3 and the plunger seal 13 increases, which affects driving of the plunger 3 and shortens sealing life of the plunger seal 13.

Because of this, it is necessary to control a dimensional tolerance of an inner diameter of the hole 20 to reduce the clearance from an outside shape of the plunger 3. However, the pump body 18 is made of metal such as stainless steel and the plunger 3 which comes in contact with an inner peripheral face of the hole 20 seizes up, which sets a limitation on reduction of the inner diameter of the hole 20.

Therefore, if the solution sending pressure is high pressure over 70 MPa, for example, a backup ring 22 is disposed on a back face of a plunger seal 13 as shown in FIG. 4A (see Japanese Patent Application Laid-Open No. 2001-254686, for example). Material of the backup ring 22 is a resin material such as PEEK (polyether ether ketone) resin which is harder than material of the plunger seal 13 and does not affect the plunger 3 when the backup ring 22 comes in contact with the outer periphery of the plunger 3.

However, if the backup ring 22 made of the PEEK resin is used under a condition of higher sending pressure over 100 MPa, the plunger seal 13 is deformed under the high pressure to press against the backup ring 22, the backup ring 22 is deformed inward in a radial direction, and an inside diameter of the backup ring 22 reduces to increase contact resistance with the plunger 3, which affects driving of the plunger 3.

On the other hand, if material having a higher elastic modulus than the PEEK resin is used for the backup ring 22 as a resin which can bear deformation of the plunger seal 13 in order to prevent deformation of the backup ring 22, the backup ring 22 is not deformed at all, and therefore, the plunger seal 13 is deformed inward in the radial direction to apply a greater tightening force on the plunger 3, which affects driving of the plunger 3 and shortens the sealing life of the plunger seal 13.

SUMMARY OF THE INVENTION

An object of the present invention is therefore to suppress shortening of sealing life in solution sending and to achieve normal driving of the plunger under a condition of high solution sending pressure over for example 100 MPa.

A solvent delivery pump according to the invention includes: a pump head having a solution inlet for sucking a solution, a pump chamber for storing the solution sucked from the solution inlet, and a solution outlet for discharging the solution in the pump chamber; a plunger having the tip end inserted into the pump head to slide in the pump head; a plunger seal mounted to a portion of the pump head through which the plunger is inserted and having a ring shape provided with a hole through which the plunger passes to seal a clearance between the pump head and the plunger; and a disk-shaped backup ring mounted to a back face side of the plunger seal and provided with a hole through which the plunger passes. The backup ring is a combined backup ring having a face in contact with the back face of the plunger seal, substantially made of deformable resin, and an inner peripheral face of the hole through which the plunger passes, substantially made of non-deformable resin. The deformable resin has a higher elastic modulus than that of the plunger seal, high enough so as to be able to absorb deformation of the plunger seal and the non-deformable resin has a higher elastic modulus than that of the deformable resin.

In this solvent delivery pump, the description, "the face of the combined backup ring in contact with the back face of the plunger seal is substantially made of deformable resin" means that the entire face of the combined backup ring in contact with the back face of the plunger seal is not necessarily made of the deformable resin. Even if a part of the face of the backup ring in contact with the back face of the plunger seal includes the non-deformable resin, the face of the combined backup ring in contact with the back face of the plunger seal can be said to be substantially made of the deformable resin, if the face made of the deformable resin makes up such a proportion of the face of the backup ring in contact with the back face of the plunger seal that the face of the backup ring can absorb deformation of the plunger seal. In other words, one part of the face of the combined backup ring in contact with the back face of the plunger seal may be made of the non-deformable resin.

Similarly, the description, "the inner peripheral face of the combined backup ring is substantially made of non-deformable resin" means that the entire inner peripheral face of the combined backup ring is not necessarily made of the non-deformable resin. If an amount of deformation of the inner peripheral face of the hole of the combined backup ring in solution sending under high pressure is such an amount as not to obstruct driving of the plunger, the deformable resin may exist on the inner peripheral face of the hole.

An example of a combination of the deformable resin and the non-deformable resin forming the combined backup ring is polyether ether ketone resin as the deformable resin and non-thermoplastic polyimide resin as the non-deformable resin.

In the invention, because the combined backup ring provided on the back face side of the plunger seal has the face in contact with the back face of the plunger seal, substantially made of the deformable resin, and the inner peripheral face substantially made of the non-deformable resin, the deformation of the plunger seal due to the pressure in the pump chamber is absorbed by the deformable resin in the combined backup ring while the inner peripheral face which is made of the non-deformable resin is less likely to be deformed when the inner peripheral face is pressed due to the deformation of the plunger seal, and therefore, the inner diameter of the combined backup ring is less likely to reduce. As a result, it is possible to suppress increase in frictional force between the backup ring and the plunger while suppressing increase in frictional force between the plunger seal and the plunger. In this way, it is possible to suppress shortening of life of the plunger seal while minimizing influence on the driving of the plunger caused by the increase in the frictional force between the plunger seal and the plunger, and the increase in the frictional force between the backup ring and the plunger.

DETAILED DESCRIPTION OF THE INVENTION

Figure 1A:
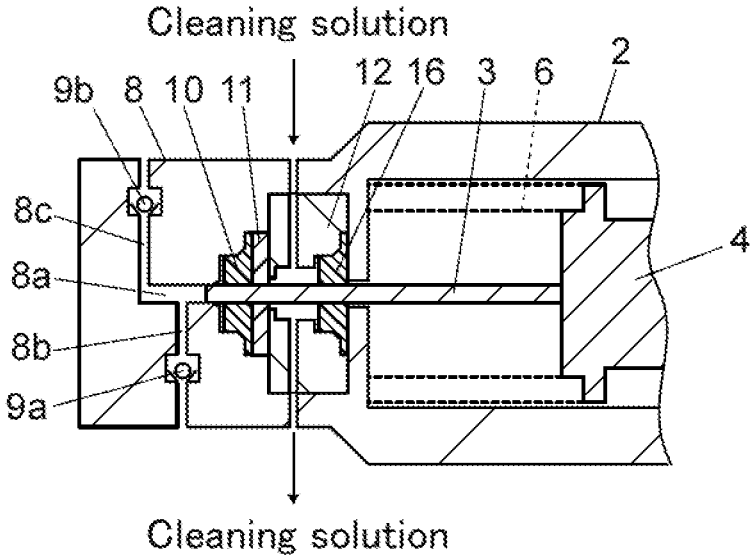
FIG. 1A is a sectional view of a tip end side portion, of a pump body in an example of a solvent delivery pump.

An example of a solution pump will be described by using FIGS. 1A and 1B. As shown in FIG. 1A, the solvent delivery pump in the example is provided with a pump head 8 at the tip end of a pump body 2 with a cleaning chamber 12 interposed therebetween. In the pump body 2, a cross head 4 is housed movably. The cross head 4 is constantly biased by a resilient body 6 such as a spring in such a direction away from the pump head 8 (rightward in FIG. 1A) and follows a peripheral face of a cam (not shown) provided on a side of a base end portion of the cross head 4. The cross head 4 reciprocates in directions toward and away from the pump head 8 (leftward and rightward in FIG. 1A) in the pump body 2 by following the peripheral face of the rotating cam.

A base end portion of the plunger 3 is retained on the tip end of the cross head 4. The tip end portion of the plunger 3 is inserted into a pump chamber 8*a* formed in the pump head 8 through the cleaning chamber 12. The tip end portion of the plunger 3 slides along a wall face of the pump chamber 8*a* as the cross head 4 reciprocates. The pump head 8 includes a solution inlet flow path 8*b* for taking a solution into the pump chamber 8*a* and a solution outlet flow path 8*c* for pushing the solution out of the pump chamber 8*a*. Check valves 9*a* and 9*b* for preventing back-flow are provided on the solution inlet flow path 8*b* and the solution outlet flow path 8*c*, respectively.

At a portion of the pump chamber 8*a* through which the plunger 3 is inserted, a plunger seal 10 for retaining an outer peripheral face of the plunger 3 so that the plunger 3 can slide in order to prevent leakage of the solution from a clearance between the inner wall of the pump chamber 8*a* and the peripheral face of the plunger 3 and a backup ring 11 for supporting a back face of the plunger seal 10 are provided. A back face of the backup ring 11 is supported by a wall face of the cleaning chamber 12.

The cleaning chamber 12 includes, in itself, a flow path through which a cleaning solution flows and a space for cleaning the outer peripheral face of the plunger 3, which passes through the cleaning chamber 12, with the cleaning solution. At a portion of the inner space of the cleaning chamber 12 through which the plunger 3 is inserted, a cleaning seal 16 for retaining the outer peripheral face of the plunger 3 so that the plunger 3 can slide is provided in order to prevent leakage of the cleaning solution. A back face of the cleaning seal 16 is supported by a wall face of the pump body 2.

In this solvent delivery pump, as a result of driving of the plunger 3 in such a direction away from the pump chamber 8*a* (rightward in FIG. 1A), pressure in the pump chamber 8*a* is reduced, the check valve 9*b* is closed, the check valve 9*a* is opened, and the solution is sucked from the solution inlet flow path 8*b* into the pump chamber 8*a*. On the other hand, as a result of driving of the plunger 3 in such a direction that the plunger 3 is inserted into the pump chamber 8*a* (leftward in FIG. 1A), the inside of the pump chamber 8*a* is pressurized, the check valve 9*a* is closed, the check valve 9*b* is opened, and the solution is pushed out from the pump chamber 8*a* into the solution outlet flow path 8*c*. By repeating this operation, the solution is sent.

By using FIG. 1B, the plunger seal 10 and the backup ring 11 will be described.

The plunger seal 10 is made of elastic material such as polyethylene resin. In an area of the plunger seal 10 around the plunger 3, a rectangular space 10*a* open on a side of the pump chamber 8*a* is formed to store the solution leaking from between the inner wall of the pump chamber 8*a* and the outer periphery of the plunger 3. The space 10*a* is in a ring shape coaxial with the plunger 3 and has a rectangular sectional shape in an axial direction of the plunger 3.

Holes through which the plunger 3 passes are respectively formed in the plunger seal 10 and the backup ring 11, and a diameter of the hole in the backup ring 11 is greater than that of the hole in the plunger seal 10. The diameter of the hole in the backup ring 11 is smaller than that of a hole 14 in the wall face of the cleaning chamber 12 supporting the backup ring 11 through which the plunger 3 passes.

The backup ring 11 is a combined backup ring made up of two types of resin layers, i.e., a deformable resin layer 11*a* and a non-deformable resin layer 11*b*. The deformable resin layer 11*a* has a higher elastic modulus than that of the plunger seal 10 and is a layer made of resin having such an elastic modulus as to be able to absorb deformation of the plunger seal 10 when the plunger seal 10 is deformed under pressure. Material of the deformable resin layer 11*a* is for example PEEK resin. On the other hand, the non-deformable resin layer 11*b* is a layer made of resin having the higher elastic modulus than the resin of the deformable resin layer 11*a*, and the elastic modulus is high enough to the extent that the resin is not deformed under pressure as high as for example about 100 MPa. Material of the non-deformable resin layer 11*b* is for example non-thermoplastic polyimide resin. An example of the non-thermoplastic polyimide resin is Vespel (registered trademark, a product of E. I. du Pont de Nemours and Company).

The backup ring 11 is formed so that its face in contact with the back face of the plunger seal 10 is a face of the deformable resin layer 11*a*, and an inner peripheral face facing the plunger 3 is a face of the non-deformable resin layer 11*b*. The backup ring 11 is in a disk shape having, at its center, a hole through which the plunger 3 passes and includes the deformable resin layer 11*a* on a side of the plunger seal 10 and the non-deformable resin layer 11*b* on a side of the cleaning chamber 12. Both the deformable resin layer 11*a* and the non-deformable resin layer 11*b* have triangular sectional shapes in the axial direction of the plunger 3 and a boundary between both the resin layers 11*a* and 11*b* extends from an inner-diameter edge on the side of the plunger seal 10 to an outer-diameter edge on the side of the cleaning chamber 12.

Because the face in contact with the back face of the plunger seal 10 is the face of the deformable resin layer 11*a*, deformation of the plunger seal 10 due to the high pressure in the pump chamber 8*a* is absorbed by elasticity of the deformable resin layer 11*a* when the pressure in the pump chamber 8*a* increases. As a result, the plunger seal 10 becomes less likely to be deformed inward in the radial direction and increase in the frictional force between the plunger 3 and the plunger seal 10 is suppressed. Although the backup ring 11 is pressed by deformation of the plunger seal 10, the inner peripheral face of the backup ring 11 is the face of the non-deformable resin layer 11*b*, and therefore, inward deformation of the backup ring 11 in the radial direction is suppressed, and the increase in the frictional force between the plunger 3 and the backup ring 11 is suppressed.

Figure 1B:
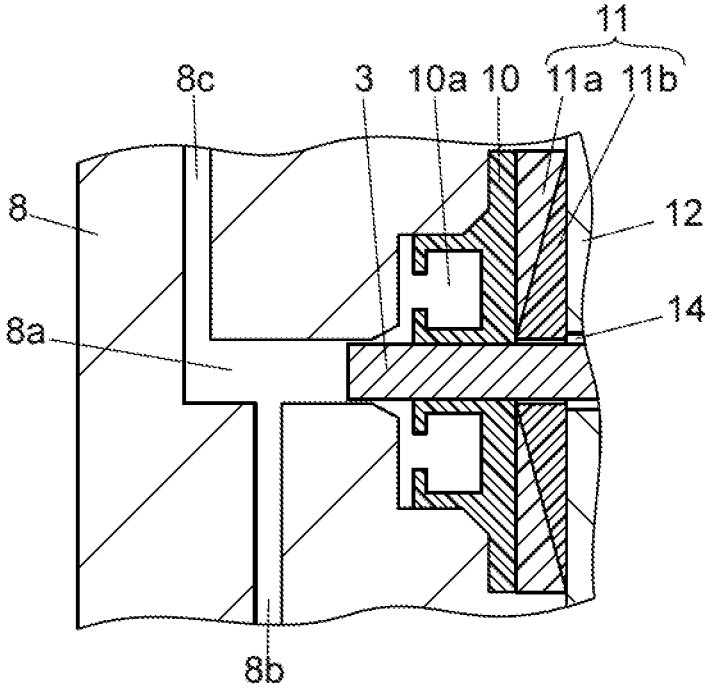
FIG. 1B is an enlarged sectional view of a vicinity of a pump chamber in FIG. 1A.
Figure 2A:
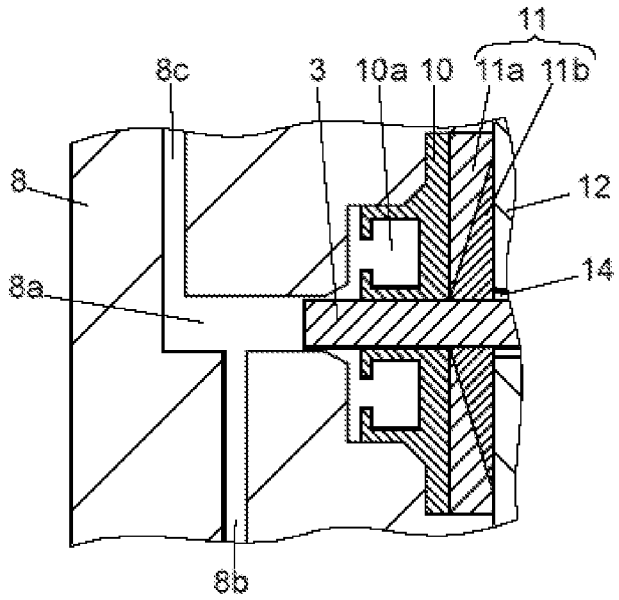
FIGS. 2A and 2B are sectional views of the vicinity of the pump chamber, showing a variation of a backup ring of the solvent delivery pump in the example.

Although the resin layers 11*a* and 11*b* are combined so that the deformable resin layer 11*a* is positioned on the back face side of the plunger seal 10 and that the non-deformable resin layer 11*b* is positioned on the side of the cleaning chamber 12 on opposite sides of a diagonal line of a section of the backup ring 11 in the axial direction of the plunger 3 as the boundary in the example in FIG. 1B, the same effect can be obtained by such a combining method that a portion of the deformable resin layer 11*a* on an outer-diameter side is in contact with the wall face of the cleaning chamber 12 and that the sectional shape of the deformable resin layer 11*a* in the axial direction of the plunger 3 is a trapezoid as shown in FIG. 2A.

Figure 2B:
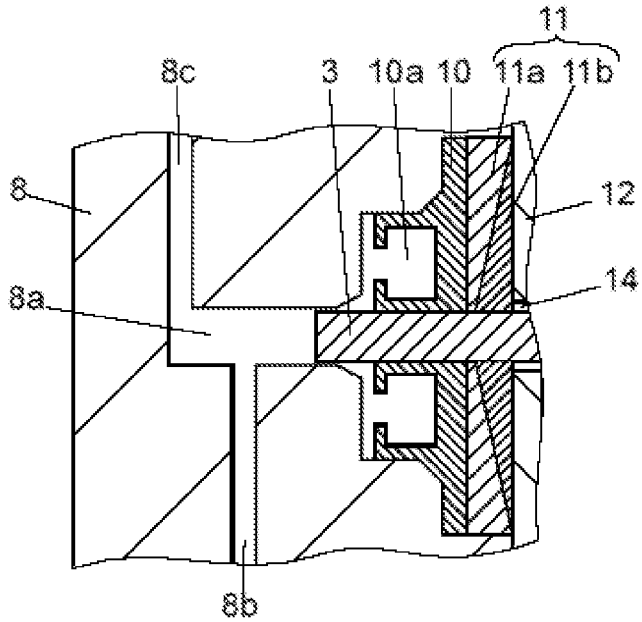
Figure 3A:
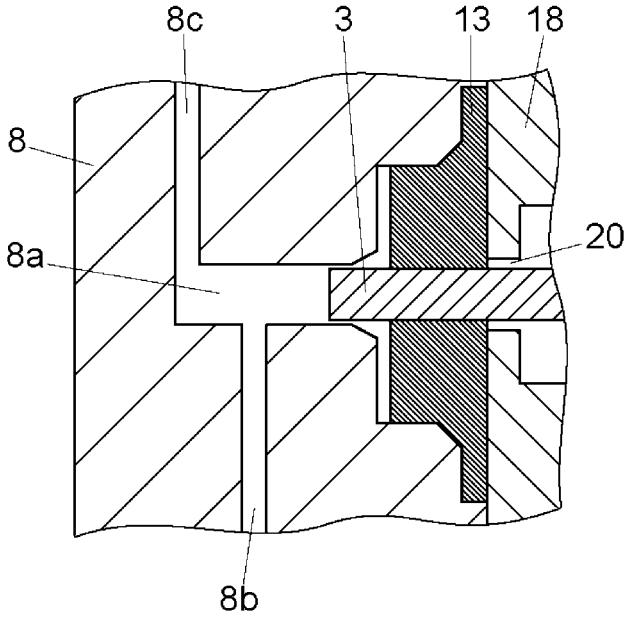
Fig. 3A Prior art
FIG. 3A is a sectional view of a vicinity of a pump chamber at normal times, showing an example of a conventional solvent delivery pump.
Figure 3B:
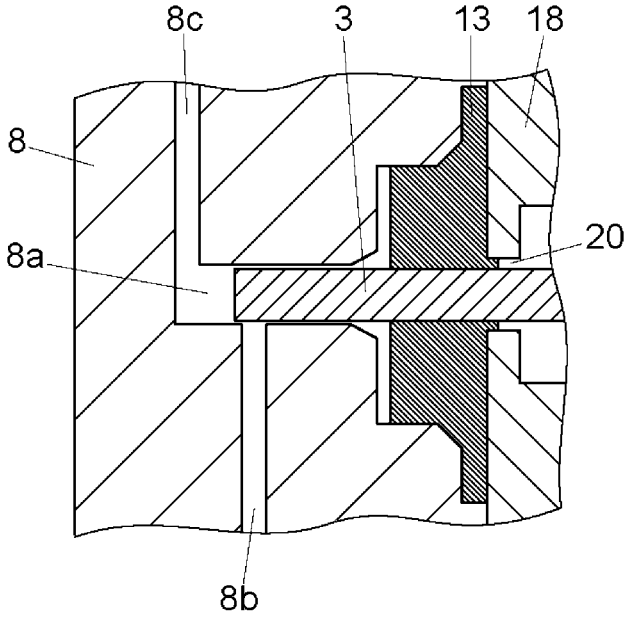
Fig. 3B Prior art
FIG. 3B is a sectional view of the vicinity of the pump chamber when an abnormal condition occurs.
Figure 4A:
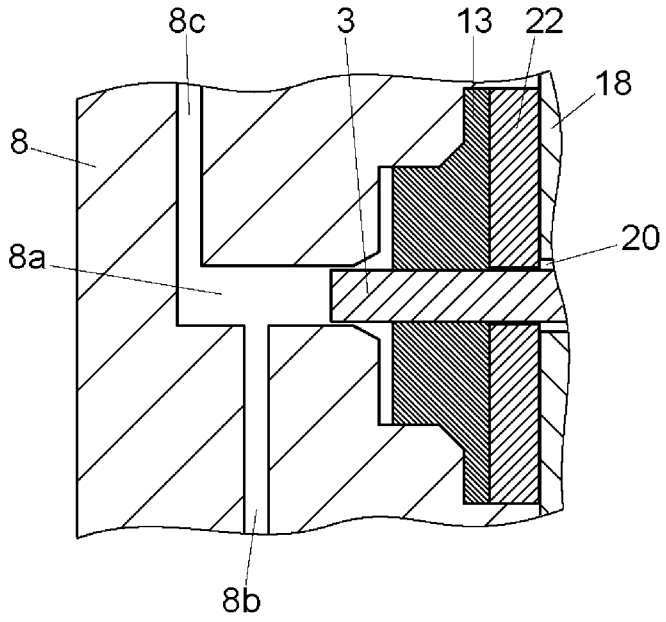
Fig. 4A Prior art
FIG. 4A is a sectional view of a vicinity of a pump chamber at normal times, showing an example of a solvent delivery pump having a conventional backup ring.
Figure 4B:
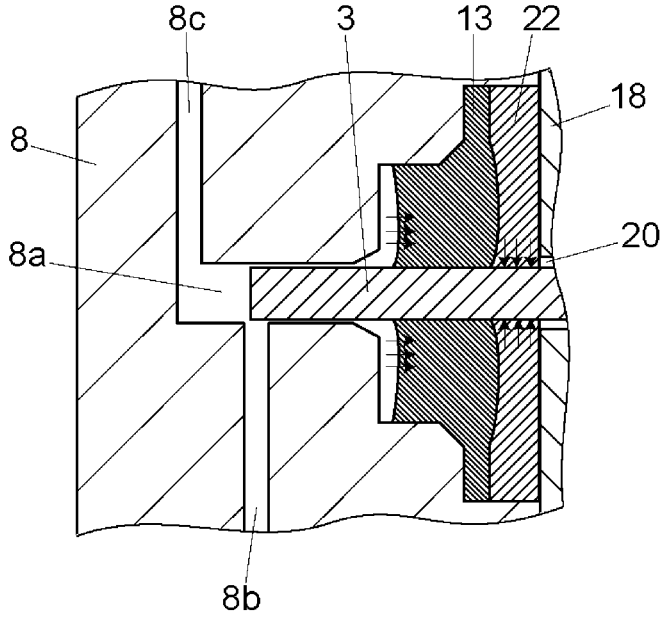
Fig. 4B Prior art
FIG. 4B is a sectional view of the vicinity of the pump chamber when high pressure is applied on a plunger seal.

If the deformable resin layer 11*a* faces a portion of an inner peripheral face of the hole of the backup ring 11 as shown in FIG. 2B, the inner diameter of the deformable resin layer 11*a* facing the inner peripheral face reduces when the deformable resin layer 11*a* is pressed by deformation of the plunger seal 10 and the frictional force between the backup ring 11 and the plunger 3 increases to some extent. However, if an area of the deformable resin layer 11*a* in contact with the plunger 3 is small, it is possible to suppress the increase in the frictional force between the backup ring 11 and the plunger 3 as compared with a case in which the entire inner peripheral face is made of the deformable resin.

Moreover, a portion of the face in contact with the back face of the plunger seal 10 may be the non-deformable resin layer 11*b*, and it is essential only that the deformation of the plunger seal 10 can be absorbed by the deformable resin layer 11*a*.

The invention claimed is:

1. A solvent delivery pump comprising:

a pump head having a solution inlet for sucking a solution, a pump chamber for storing the solution sucked from the solution inlet, and a solution outlet for discharging the solution in the pump chamber;

a plunger having a tip end inserted into the pump head to slide in the pump head;

a plunger seal mounted to a portion of the pump head through which the plunger is inserted, the plunger seal being disposed at a position which is subjected to a high pressure of the pump chamber and having a ring shape provided with a hole through which the plunger passes to seal a clearance between the pump head and the plunger; and a disk-shaped backup ring mounted to a back face side of the plunger seal, provided with a hole through which the plunger passes, wherein the backup ring is a combined backup ring comprising first and second portions, the first portion having a face in contact with the back face of the plunger seal and being substantially made of deformable resin, and the second portion having an inner peripheral face of the hole through which the plunger passes and being substantially made of non-deformable resin;

the deformable resin has a higher elastic modulus than that of the plunger seal and has such an elastic modulus as to be able to absorb deformation of the plunger seal, and the non-deformable resin has a higher elastic modulus than that of the deformable resin;

wherein the first and second portions have triangular cross-sectional shapes in a plane common to an axis of the plunger.

2. The solvent delivery pump according to claim 1, wherein a diameter of the hole of the backup ring is greater than a diameter of the hole in the plunger seal.

3. The solvent delivery pump according to claim 2, wherein the backup ring is supported on a wall face of a cleaning chamber having a hole through which the plunger passes and a diameter of the hole of the backup ring is smaller than a diameter of the hole in the cleaning chamber.

4. The solvent delivery pump according to claim 1, wherein the deformable resin is a polyether ether ketone resin and the non-deformable resin is non thermoplastic polyimide resin.

5. A solvent delivery pump comprising:

a pump head having a solution inlet for sucking a solution, a pump chamber for storing the solution sucked from the solution inlet, and a solution outlet for discharging the solution in the pump chamber;

a plunger having a tip end inserted into the pump head to slide in the pump head;

a plunger seal mounted to a portion of the pump head through which the plunger is inserted, the plunger seal being disposed at a position which is subjected to a high pressure of the pump chamber and having a ring shape provided with a hole through which the plunger passes to seal a clearance between the pump head and the plunger; and a disk-shaped backup ring mounted to a back face side of the plunger seal, provided with a hole through which the plunger passes, wherein the backup ring is a combined backup ring comprising first and second potions, the first portion having a face in contact with the back face of the plunger seal and being substantially made of deformable resin, and the second portion having an inner peripheral face of the hole through which the plunger passes and being substantially made of non-deformable resin and has a triangular cross-sectional shape;

the deformable resin has a higher elastic modulus than that of the plunger seal and has such an elastic modulus as to be able to absorb deformation of the plunger seal, and the non-deformable resin has a higher elastic modulus than that of the deformable resin;

wherein the first portion has a trapezoidal cross-sectional shape in a plane common to an axis of the plunger.

6. The solvent delivery pump according to claim 5, wherein a diameter of the hole of the backup ring is greater than a diameter of the hole in the plunger seal.

7. The solvent delivery pump according to claim 6, wherein the backup ring is supported on a wall face of a cleaning chamber having a hole through which the plunger passes and a diameter of the hole of the backup ring is smaller than a diameter of the hole in the cleaning chamber.

8. The solvent delivery pump according to claim 5, wherein the deformable resin is a polyether ether ketone resin and the non-deformable resin is non thermoplastic polyimide resin.

* * * * *